US006382171B1

(12) United States Patent
Narita et al.

(10) Patent No.: US 6,382,171 B1
(45) Date of Patent: May 7, 2002

(54) LUBRICATING DEVICE FOR INTERNAL COMBUSTION ENGINE

(75) Inventors: Satoru Narita; Toshiyuki Kubota, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/655,060

(22) Filed: Sep. 5, 2000

(30) Foreign Application Priority Data

May 9, 1999 (JP) ..... 11-291415

(51) Int. Cl.[7] ..... F01M 11/02
(52) U.S. Cl. ..... 123/196 R
(58) Field of Search ..... 123/196 R, 196 AB, 123/196 W, 195 H

(56) References Cited

U.S. PATENT DOCUMENTS 3,961,614 A * 6/1976 Rameau ..... 123/196 R
4,944,265 A * 7/1990 Davey ..... 123/196 R
5,163,394 A * 11/1992 Koishikawa et al. ... 123/196 W
5,517,959 A * 5/1996 Kato et al. ..... 123/196 AB
5,588,406 A * 12/1996 Ito et al. ..... 123/90.34
5,743,230 A * 4/1998 Yamazaki et al. ..... 123/195 H
5,887,565 A * 3/1999 Ozeki et al. ..... 123/196 R
6,016,784 A * 1/2000 Tanaka ..... 123/196 R
6,182,625 B1 * 2/2001 Ozeki et al. ..... 123/196 R

FOREIGN PATENT DOCUMENTS

JP 6242089 10/1987

* cited by examiner

*Primary Examiner*—Noah P. Kamen
*Assistant Examiner*—Jason A Benton
(74) *Attorney, Agent, or Firm*—Birch, Stewart, Kolasch & Birch, LLP

(57) ABSTRACT

A crank case is divided in the longitudinal direction into a front case and a rear case. The front and rear cases are fastened to each other with bolts. A bolt hole through which the bolt passes has a diameter larger than that of the bolt. The bolt hole forms part of an oil passage. The connection end plane on the front case side has an oil groove extending from the right end side to the left end side of the connection end plane. The oil groove is in communication with a communication port at the right end of the connection end plane, and is in communication with an oil passage formed around a bolt at the left end of the connection end plane. With this construction, it becomes easy to form an oil passage in a crank case which is divided into two parts in the longitudinal direction without the need of provision of any special piping.

15 Claims, 3 Drawing Sheets

LUBRICATING DEVICE FOR INTERNAL COMBUSTION ENGINE

BACKGROUND OF THE INVENTION

1. Field of the Invention

The present invention relates to a lubricating device for an internal combustion engine. In particular, the present invention relates to an advantageous oil passage structure provided in a crank case of an internal combustion engine.

2. Description of Related Art

The provision of an oil passage in an engine has been made by piping a separate part such as a pipe in the engine (disclosed, for example, in Japanese Utility Model Publication No. Sho 62-42089); providing a groove in one of parting planes of a case and a cover and covering the groove with the other of the cage and cover, to form an oil passage; or forming a circumferential groove in a bearing surface of a bearing.

The above method of piping a separate part is disadvantageous in that the number of parts is increased. Furthermore, since the space for piping must be ensured, it is difficult to obtain a compact engine. The method of making use of the parting plane is disadvantageous in that it may be difficult to form a shorter oil passage because the position of the oil passage is limited to the parting plane. The method of forming a specialized oil passage by machining is disadvantageous in that such machining requires a special machining apparatus and the number of steps is increased. Furthermore, since a location at which the oil passage is to be formed must be ensured, it is difficult to obtain a compact engine.

SUMMARY OF THE INVENTION

An object of the present invention is to provide a lubricating device for an internal combustion engine, which is capable of solving above-identified problems of the related art.

To achieve the above object, according to the present invention, there is provided a lubricating device for an internal combustion engine in which a crank case is divided into first and second divided crank case parts, wherein oil is supplied from an oil pump provided in the first divided crank case part to portions to be lubricated, which portions are provided in the second divided crank case part, characterized in that the diameter of a fastening bolt hole, through which a bolt passes for fastening the first and second divided crank case parts to each other, is larger than the diameter of the bolt; and part of the bolt hole is communicated to another oil passage, to constitute part of an oil supply passage communicated to the second crank case part side.

According to the present invention, since an oil passage is formed by making use of part of a bolt hole through which a bolt passes for connecting two divided crank case parts (first and second divided crank case parts) of a crank case to each other, oil having been fed from an oil pump in the first divided crank case is supplied, via the oil passage in the bolt hole, to another oil passage for supplying the oil to portions to be lubricated of the second divided crank case part. As a result, special machining and special machining equipment are not required to form the oil passage; the number of parts is reduced; and since the location to be machined is not required to be set at a portion different from the bolt hole, the engine can be made compact. Furthermore, since part of the bolt hole used as the oil passage extends in the direction perpendicular to the parting planes of the divided crank case parts, another oil passage in communication with an oil pump in the first divided crank case can be in communication with an oil supply passage in communication with the second divided crank case part by way of the shortest oil passage composed of part of the bolt hole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
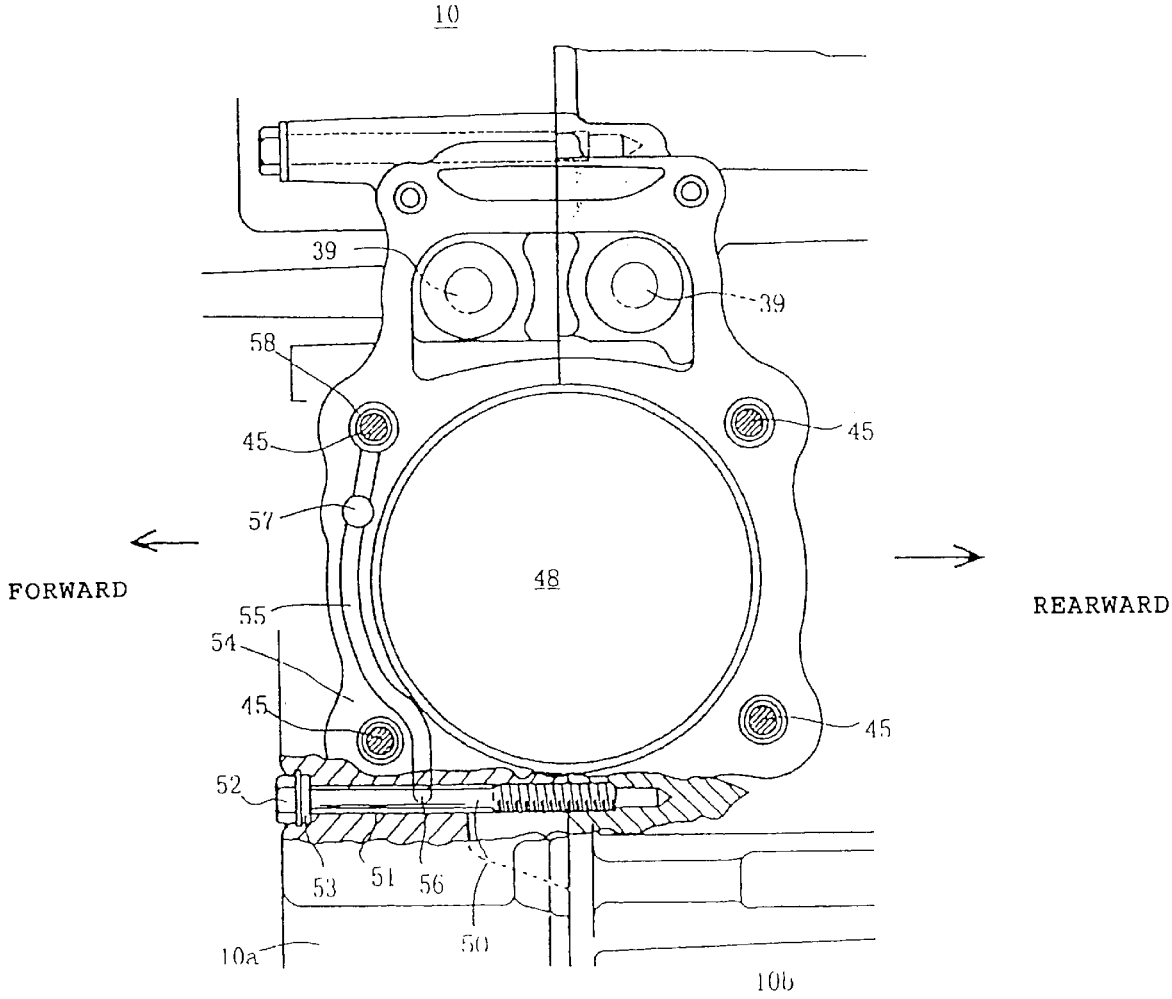
FIG. 1 is a view from above a bore of a connection portion between front and rear cases according to an embodiment of the present invention.

Hereinafter, one embodiment of the present invention will be described with reference to the accompanying drawings. First, the entire structure of a four-wheel buggy to which the present invention is applied will be described with reference to FIG. 2. The four-wheel buggy includes a pair of right and left front wheels 2 and a pair of right and left rear wheels 3 provided on a front portion and a rear portion of a body frame 1, respectively. A power unit 4, which integrally includes an engine and a transmission, is supported by a central portion of the body frame 1. The power unit 4 is of a longitudinally arranged type in which a crank shaft 5 is arranged in the longitudinal direction of the vehicular body.

The four-wheel buggy, which is of the four-wheel driven type, includes an output shaft 6 which is provided under the power unit 4 in such a manner as to be in parallel with the crank shaft 5. The front wheels 2 are driven by an engine output transmitted from the output shaft 6 via a front wheel propeller shaft 7 and the rear wheels 3 are driven by the engine output transmitted from the output shaft 6 via a rear wheel propeller shaft 8.

The front side of a crank case 10 constituting the power unit 4 is covered with a front case cover 11, and the rear side of the crank case 10 is covered with a rear case cover 12. The crank case 10 and the front and rear case covers 11 and 12 constitute a power unit cage. The crank case 10 is divided in the longitudinal direction into a front case 10*a* and a rear case 10*b*. A cylinder block 13, a cylinder head 14, and a cylinder head cover 15 are mounted on the crank case 10. A carburetor 16 is connected to an intake port of the cylinder head 14, and an air cleaner 17 is connected to the rear side of the carburetor 16. An exhaust pipe 18 is connected to an exhaust port of the cylinder head 14.

Figure 2:
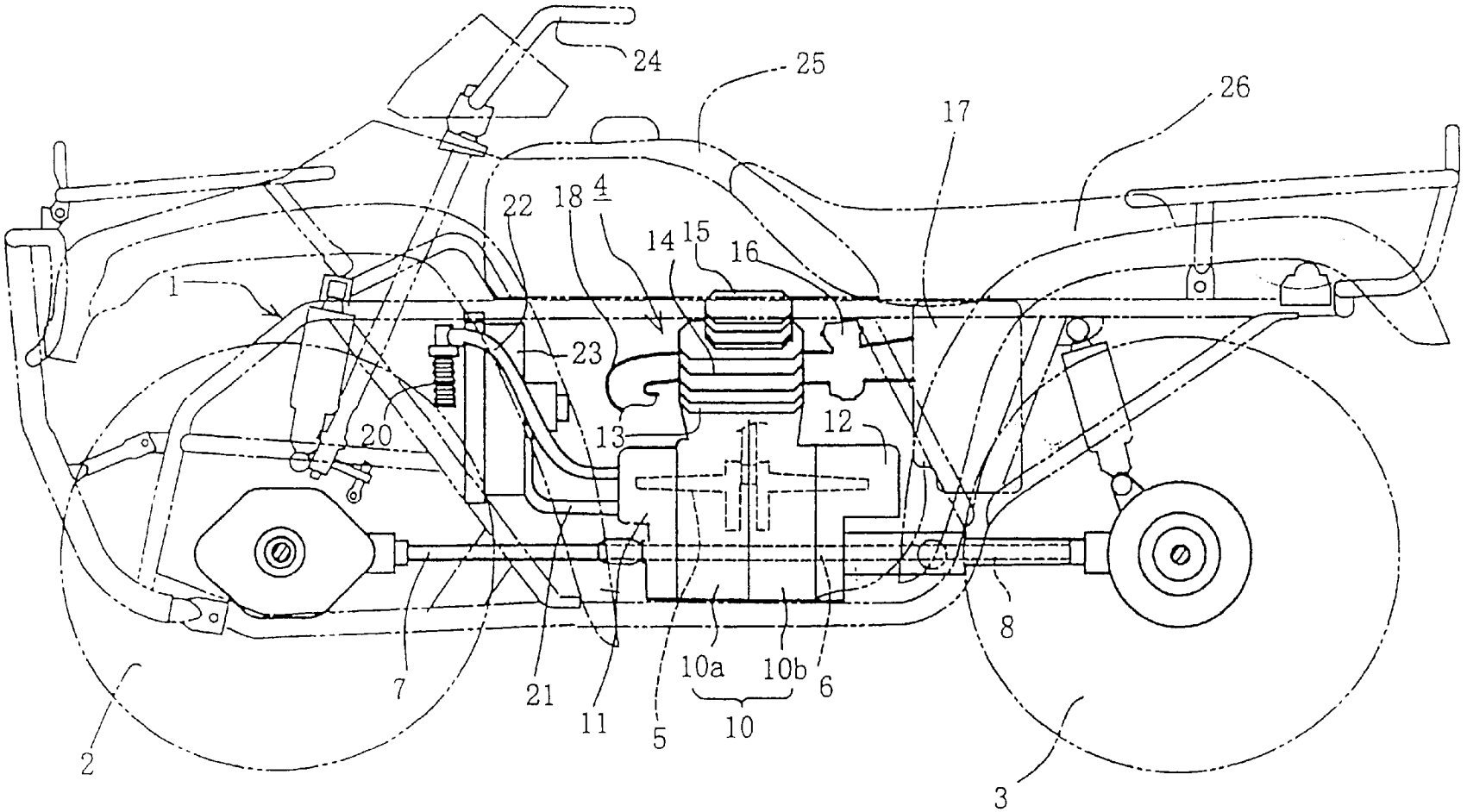
FIG. 2 is a side view illustrating an essential portion of a vehicular body of a four-wheel buggy to which the present invention is applied.

An oil cooler 20 is disposed in front of the power unit 4. The oil cooler 20 is communicated via a feed side hose 21 to an oil pump provided in the crank case 10, and is also communicated via a return side hose 22 to the oil pump in the crank case 10. In FIG. 2, reference numeral 23 designates a cooling fan, 24 is a handlebar, 25 is a fuel tank, and 26 is a saddle type seat.

Figure 3:
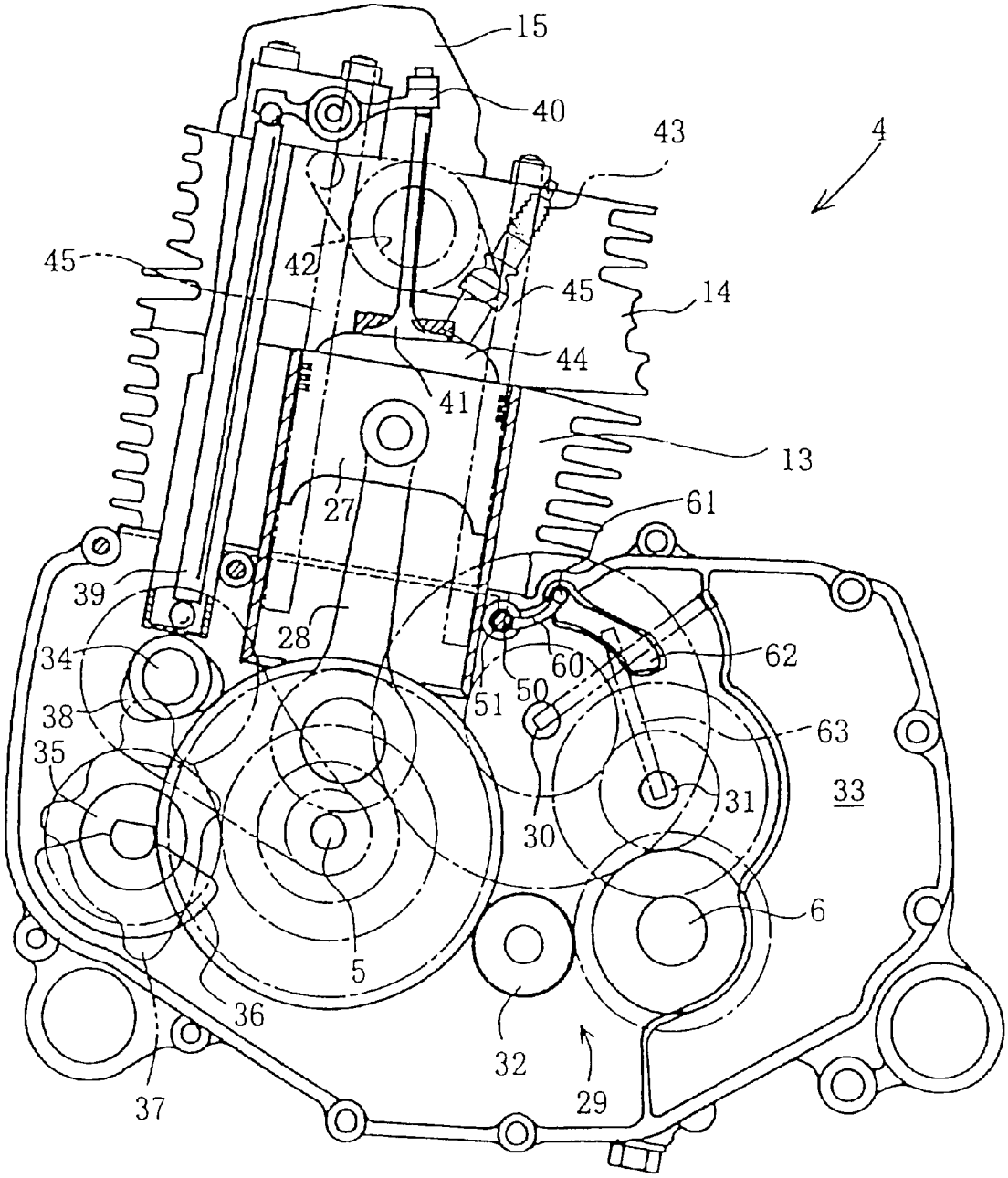
FIG. 3 is a schematic view showing a parting plane of the rear case according to the embodiment of the present invention.

FIG. 3 schematically shows, from the front to the rear of the power unit 4, a parting plane of the rear case 10*b* to the front case 10*a*. Referring to FIG. 3, in the crank case 10, a main shaft 30, a counter shaft 31, a shift shaft 32, and the output shaft 6 are vertically disposed on the right side in the figure (left side of the vehicular body) from the crank shaft 5 which connects a piston 27 to a connecting rod 28. Furthermore, an oil tank 33 formed into an approximately crescent-shape is disposed on the right side from the shafts 30, 31, 32 and 6.

In the crank case 10, a cam shaft 34 and a balancer shaft 35 are vertically disposed on the left side in the figure (right side of the vehicular body) from the crank shaft 5. Both the cam shaft 34 and the balancer shaft 35 are driven by the crank shaft 5. A balancer 36 is provided on the balancer shaft 35. An oil pump 37 is coaxially provided on the front end of the balancer shaft 35. A cam 38 is provided around the cam shaft 34. The cam 38 is slid in contact with the lower end of a push rod 39 disposed in the vertical direction, to move the push rod 39 in the vertical direction, thereby driving an exhaust valve 41 via a rocker arm 40. It should be noted that an intake side valve (invisible in the figure) is driven in the same manner as that described above. In FIG. 3, reference numeral 42 designates an exhaust port, 43 is an ignition plug, 44 is a combustion chamber, and 45 is a long-sized bolt for fastening the cylinder block 13 and the cylinder head 14 to the crank case 10 side.

The oil pump 37 is a compact oil pump including a feed pump and a scavenging pump disposed in the same housing. The feed pump functions to suck oil from the bottom portion of the oil tank 33, and to feed the oil via an oil filter to components in the engine such as the crank shaft 5, a valve mechanism, and a transmission 29 for lubricating the components.

The scavenging pump functions to suck the oil, which has been, after lubrication, dropped on the bottom of the crank case 10 and collected at an approximately central portion of the bottom of the crank case 10 in the lateral direction, and feed the oil to the oil cooler 20 via the feed side hose 21. The oil thus cooled by the oil cooler 20 is returned from the oil cooler 20 to the oil tank 33. Each of the rear case 10*b* and the front case 10*a* (not shown in FIG. 3) of the crank case 10 is shaped such that the right and left sides of the bottom thereof are each tilted toward the central portion. The central portion of the bottom of the rear case 10*b* and the front case 10*a* located immediately under the crank shaft 5 and the transmission is the lowest point.

Referring to FIG. 1, the parting planes of the front case 10*a* and the rear case 10*b* are overlapped with each other in the longitudinal direction, and are fastened to each other by bolts 50 inserted in the front and rear cases 10*a* and 10*b* in the direction from the front to the rear of the vehicular body. A bolt hole 51 through which the bolt 50 passes has a diameter larger than the outside diameter of the bolt 50. A portion of the bolt hole 51 is extended in the direction perpendicular to the parting planes of the front and rear cases 10*a* and 10*b*, to form part of an oil passage. A head 52 of the bolt 50 is closely fastened, via a sealing washer 53, to a seat portion provided in the opening portion of the bolt hole 51, to thereby prevent the permeation of oil from the bolt hole 51 and to ensure a pressure receiving area of the bolt 50 in the circumferential direction.

The front case 10*a* and the rear case 10*b* have connection end planes which are to be connected to the cylinder block 13 while surrounding a bore 48. An oil groove 55 in communication with the bolt hole 51 is formed in the connection end plane 54 of the front case 10*a*. The oil groove 55 is an upwardly opened groove formed by engraving the connection end plane 54. When the cylinder block 13 is connected to the connection end planes, an oil passage is formed between the oil groove 55 and the cylinder block 13 covering the oil groove 55. The oil groove 55 extends, along the bore 48, from the right end side (lower side in FIG. 1) to the left end side (upper side in FIG. 1) of the connection end plane 54. To be more specific, the oil groove 55 is in communication with the bolt hole 51 at a connection port 56 of the right end of the connection end plane 54, in communication with an oil passage 57 vertically pierced at an intermediate portion of the connection end plane 54, and in communication with an oil passage 58 formed around a bolt 45 at the left end of the connection end plane 54. The bolt 45 is provided at each of four corners around the bore 48. The oil passage 58, which is formed by a gap between the periphery of the bolt 45 and the cylinder block 13, is used to introduce oil for lubricating the valve mechanism and the like on the upper side.

Referring again to FIG. 3, the bolt hole 51 around the bolt 50 is in communication with a communication port 61 provided over the bolt hole 51 via a communication passage 60 provided on the upper portion of the front case 10*a*. The communication port 61 is in communication with an oil chamber 62 formed longer in the lateral direction along the upper end portion of the rear case 10*b*. An oil passage 63, which is in communication with an end portion of an oil passage extending in a shaft hole of the counter shaft 31 and which extends upwardly therefrom, is in communication with the oil chamber 62. Accordingly, oil supplied from the feed pump of the oil pump 37 is supplied to the counter shaft 31 by way of the oil groove 55, bolt hole 51, communication passage 60, communication port 61, and oil passage 63.

The function of this embodiment will be described below. The front case 10*a* is fastened to the rear case 10*b* with the bolts 50, and the cylinder block 13 is placed on the connection end plane 54 and is fastened thereto with the bolts 45, whereby the oil passage 58 around the bolt 45 is in communication with the bolt hole 51 around the bolt 50 via the oil groove 55 formed in the connection end plane 54 on the front case 10*a* side, and is in communication with the oil pump 37 via the communication passage 60, oil chamber 62, oil passage 63, and the shaft hole of the counter shaft 31.

As a result, the oil passage communicated from the right side to the left side of the front case 10*a* with the bore 48 located therebetween can be simply formed by the oil groove 55 without the need of any special piping. The oil grooves 55 can be easily formed in the connection end plane 54 by casting. Furthermore, since the oil passage is formed only on the front case 10*a* side of the crank case 10, machining accuracy is not required to be made as high as an oil passage formed to connect the front and rear cases 10*a* and 10*b* to each other across the parting planes thereof.

Since the oil passage configured as part of the bolt hole 51 is formed simultaneously with the formation of the bolt hole 51, it is possible to eliminate the need for machining a separate oil passage, to omit the use of special machining apparatus, and to reduce the number of processing steps.

Since it is not required to provide the oil passage at a portion different from the bolt hole 51, the engine can be made compact. Furthermore, since part of the bolt hole 51 is extended in the direction perpendicular to the parting planes of the front and rear cases 10*a* and 10*b*, the oil groove 55 and the like formed in the front case 10*a* can be connected to the oil chamber 62 and the like formed in the rear case 10*b* by way of a relatively short route.

Since the front and rear cases 10*a* and 10*b* are fastened to each other by the bolts 50 via the sealing washer 53, the pressure receiving area of each of the bolts 50 in the circumferential direction can be usually ensured. The head 52 may be made to pass through and extend outwardly from the front case 10*a* or the rear case 10*b* and the bolt 50 be fastened from the outside. In the case of forming the bolt hole by machining from the parting planes of the front and rear cases 10*a* and 10*b*, a portion, near the parting planes, of the bolt hole may be larger in diameter than that of the bolt 50 (which portion is taken as an oil passage), and the depth side of the bolt hole 50 be thinner as required to fasten the bolt 50. With this configuration, the bolt hole including the oil passage can be used for fastening the bolt to which a high axial force is applied.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating device for an internal combustion engine in which a crank case is divided into first and second divided crank case parts, wherein oil is supplied from an oil pump provided in said first divided crank case part to portions to be lubricated provided in said second divided crank case part, said lubricating device comprising:

a fastening bolt hole through which a bolt passes for fastening the first and second divided crank case parts to each other, said fastening bolt hole having a diameter larger than a diameter of said bolt; and part of said bolt hole is in communication with an oil passage, said bolt hole and said oil passage forming a portion of an oil supply passage in communication with said second divided crank case part, said oil supply passage includes an oil groove in communication with said bolt hole, said oil groove being formed in an end plane of said first divided crank case part.

2. The lubricating device according to claim 1, wherein said oil groove is in communication with a bolt hole through which a bolt for connecting one of said first and second divided crank case parts to a cylinder block of said engine passes.

3. The lubricating device according to claim 1, further comprising an oil chamber in communication with said oil passage, and a second oil passage in communication with said oil chamber for supplying oil to a counter shaft of said engine.

4. The lubricating device according to claim 3, said oil supply passage further comprising an oil groove in communication with said bolt hole, said oil groove being formed in an end plane of said first divided crank case part.

5. The lubricating device according to claim 4, wherein said oil groove is in communication with a bolt hole through which a bolt for connecting one of said first and second divided crank case parts to a cylinder block of said engine passes.

6. An internal combustion engine, comprising:

a cylinder head, said cylinder head having a cylinder head cover attached to an upper surface thereof;

a cylinder block, said cylinder block being connected to a lower surface of said cylinder head at an upper surface thereof;

a crank case divided into first and second divided crank case parts, said crank case being connected to a lower surface of said cylinder block at an end plane thereof;

an oil pump for supplying oil in said first divided crank case part to portions to be lubricated in said second divided crank case part; and a lubricating device, said lubricating device including:

fastening bolt hole through which a bolt passes for fastening said first and second divided crank case parts to each other, said fastening bolt hole having a diameter larger than a diameter of said bolt; and part of said bolt hole is in communication with an oil passage, said bolt hole and said oil passage forming a portion of an oil supply passage in communication with said second divided crank case part, said oil supply passage includes an oil groove in communication with said bolt hole, said oil groove being formed in said end plane of said crank case.

7. The internal combustion engine according to claim 6, wherein said oil groove is in communication with a bolt hole through which a bolt for connecting one of said first and second divided crank case parts to said cylinder block passes.

8. The internal combustion engine according to claim 6, further comprising:

a counter shaft mounted for rotating in said second crank case part; and an oil chamber in communication with said oil passage; and a second oil passage in communication with said oil chamber for supplying oil to said counter shaft of said engine.

9. The internal combustion engine according to claim 8, said oil supply passage further comprising an oil groove in communication with said bolt hole, said oil groove being formed in said end plane of said crank case.

10. The internal combustion engine according to claim 9, wherein said oil groove is in communication with a bolt hole through which a bolt for connecting one of said first and second divided crank case parts to said cylinder block passes.

11. A four-wheel vehicle, comprising:

a pair of left and right wheels mounted for rotation about a front portion and a rear portion of a body frame, respectively;

a power unit including an engine and a transmission, said power unit being supported at a central portion of said body frame;

front and rear shafts for transferring power from said power unit to said front and rear wheels, respectively; and wherein said engine further includes:

a cylinder head, said cylinder head having a cylinder head cover attached to an upper surface thereof;

a cylinder block, said cylinder block being connected to a lower surface of said cylinder head at an upper surface thereof;

a crank case divided into first and second divided crank case parts, said crank case being connected to a lower surface of said cylinder block at an end plane thereof, an oil pump for supplying oil in said first divided crank case part to portions to be lubricated in said second divided crank case part; and a lubricating device, said lubricating device including:

a fastening bolt hole through which a bolt passes for fastening said first and second divided crank case parts to each other, said fastening bolt hole having a diameter larger than a diameter of said bolt; and part of said bolt hole is in communication with an oil passage, said bolt hole and said oil passage forming a portion of an oil supply passage in communication with said second divided crank case part, said oil supply passage includes an oil groove in communication with said bolt hole, said oil groove being formed in said end plane of said crank case.

12. The four-wheel vehicle according to claim 11, wherein said oil groove is in communication with a bolt hole through which a bolt for connecting one of said first and second divided crank case parts to said cylinder block passes.

13. The four-wheel vehicle according to claim 11, further comprising:

a counter shaft mounted for rotating in said second crank case part; and an oil chamber in communication with said oil passage; and a second oil passage in communication with said oil chamber for supplying oil to said counter shaft of said engine.

14. The four-wheel vehicle according to claim 13, said oil supply passage further comprising an oil groove in communication with said bolt hole, said oil groove being formed in said end plane of said crank case.

15. The four-wheel vehicle according to claim 14, wherein said oil groove is in communication with a bolt hole through which a bolt for connecting one of said first and second divided crank case parts to said cylinder block passes.

* * * * *